US005867878A

United States Patent [19]

Foster et al.

[11] Patent Number: 5,867,878

[45] Date of Patent: Feb. 9, 1999

[54] FABRIC WIDTH CONTROL SYSTEM

[75] Inventors: Wayne G. Foster; David L. Kamp; John R. Everhart, all of Winston-Salem; Michael D. Hines, Lewisville; Erik D. Moore, Lexington; Jimmy F. Plyler, Salisbury; James Moore Schenck, Winston-Salem, all of N.C.

[73] Assignee: Sara Lee Corporation, Winston-Salem, N.C.

[21] Appl. No.: 865,744

[22] Filed: May 30, 1997

[51] Int. Cl.[6] ..... D06C 3/00; D06H 3/08

[52] U.S. Cl. ..... 26/74; 26/75; 26/76; 26/18.6; 356/429

[58] Field of Search ..... 26/74, 75, 76, 26/77, 18.5, 18.6, 51, 51.4, 51.5, 78, 79, 70; 356/429; 364/470.14, 470.01; 382/111; 250/559.08, 559.2, 559.24; 73/159

[56] References Cited

U.S. PATENT DOCUMENTS

| | | | |
|---|---|---|---|
| 2,088,984 | 8/1937 | Tandel | 26/76 |
| 2,312,182 | 2/1943 | Meyer | 26/75 |
| 3,204,109 | 8/1965 | Goodwin | 26/51.1 |
| 3,625,048 | 12/1971 | Roitel | 26/75 |
| 4,062,094 | 12/1977 | Kuroda | 26/75 |
| 4,275,483 | 6/1981 | Roberson | 19/240 |
| 4,305,185 | 12/1981 | Frezza | 26/75 |
| 4,414,476 | 11/1983 | Maddox et al. | 26/18.6 |
| 4,559,680 | 12/1985 | Gresens | 26/74 |
| 4,586,372 | 5/1986 | Massen | 356/430 |

*Primary Examiner*—A. Varatta
*Attorney, Agent, or Firm*—Rhodes Coats & Bennett, L.L.P.

[57] ABSTRACT

A fabric width control system for a fabric compactor for compacting a moving fabric web. The system includes a vision assembly for measuring the width of the moving fabric web downstream of the fabric compactor. A mechanical spreader is located upstream of the fabric compactor for adjusting the width of the web in response to a control signal from an open loop controller. The controller is connected to the vision assembly and the mechanical spreader for controlling the position of the mechanical spreader in response to a change in the width of the moving fabric web from a pre-set value. In the preferred embodiment, a cloth stabilizer is located downstream of the fabric compactor for maintaining the moving fabric web at a pre-determined position with respect to the vision assembly, thereby further increasing the accuracy of the system.

35 Claims, 4 Drawing Sheets

FABRIC WIDTH CONTROL SYSTEM

BACKGROUND OF THE INVENTION (1) Field of the Invention

The present invention relates generally to finishing fabric and, more particularly, to an automatic fabric width control system for a fabric compactor.

(2) Description of the Prior Art

In the manufacture of apparel, particularly t-shirts and the like, after the greige goods have been knit they are inspected and transferred to a finishing line. During finishing, the goods are bleached or dyed in preparation for cutting. Since "soft" materials, such as fabric, are not dimensionally stable and may vary from source to source, it is the general practice to run the fabric through a compactor to set the fabric before cutting.

Generally speaking, a compactor includes a mechanical spreader for spreading the fabric to a preset width and at least one pair of steam heated rolls for setting the fabric to that width. If there was little variability in finished fabric, all that would be necessary would be to set the width of the mechanical spreader and run a trial length of fabric web, make a measurement of the width of the compacted fabric and readjust the width of the mechanical spreader. However, fabric varies considerably from machine to machine based on knit type, counts per inch and other variables including variables introduced into the fabric web during finishing. Accordingly, it is necessary to constantly monitor the width of the fabric exiting the compactor. Unfortunately, it is difficult for a human operator to make adjustments on width of fabric exiting a compactor at about 80 yards a minute.

In the past, PID open loop controllers have been used to control the width between the mechanical separator bars based on the measured width of the fabric exiting the compactor. However, prior art systems using a PID open loop controller measured the width of the fabric directly and then made an adjustment in the width of the spreaders. While this seems simple enough, because of the speed that the cloth is exiting the compactor there often is no relationship between the width of the measured cloth exiting the compactor and the cloth entering the mechanical spreader on the inlet of the compactor. Accordingly, this would often cause the control system to oscillate out of control as the control system tried to correct errors that were no longer the cause of the problem.

This has become more of a problem as fabric speed has increased for more modern equipment. In addition, by the time the fabric has been finished and compacted, there is a substantial investment in the fabric which is wasted if the fabric web cannot be held to the proper dimensions for the style of the garment which is being cut from it.

Thus, there remains a need for a new and improved fabric width control system which is sufficiently sensitive to measure small changes in a high speed fabric web while, at the same time, overcomes the tendency of such a control system to go into an oscillation mode.

SUMMARY OF THE INVENTION

The present invention is directed to a fabric width control system for a fabric compactor for compacting a moving fabric web. The system includes a vision assembly for measuring the width of the moving fabric web downstream of the fabric compactor. A mechanical spreader is located upstream of the fabric compactor for adjusting the width of the web in response to a control signal from an open loop controller. The controller is connected to the vision assembly and the mechanical spreader for controlling the position of the mechanical spreader in response to a change in the width of the moving fabric web from a pre-set value.

In the preferred embodiment, the controller includes an input circuit for receiving an input signal representative of a desired fabric width of the moving fabric web downstream of the fabric compactor; an output circuit for providing a control signal to the fabric compactor; and an open loop PLC controller connected to the input circuit and the output circuit for selectively providing a first fixed control signal or a second fixed control signal for controlling the fabric compactor in response to a change in the desired fabric width of the moving fabric web from a pre-set value. This arrangement results in acceptable oscillations which are inherent in open loop control systems.

Finally, in the preferred embodiment, a cloth stabilizer is located downstream of the fabric compactor for maintaining the moving fabric web at a pre-determined position with respect to the vision assembly, thereby further increasing the accuracy of the system.

Accordingly, one aspect of the present invention is to provide a fabric width control system for a fabric compactor for compacting a moving fabric web. The system includes: (a) a vision assembly for measuring the width of the moving fabric web downstream of the fabric compactor; (b) a mechanical spreader located upstream of the fabric compactor; and (c) a controller connected to the vision assembly and the mechanical spreader for controlling the position of the mechanical spreader in response to a change in the width of the moving fabric web from a pre-set value.

Another aspect of the present invention is to provide a control system for a textile apparatus for processing a moving fabric web. The system includes: (a) an input circuit for receiving an input signal representative of a desired fabric parameter of the moving fabric web downstream of the fabric processor; (b) an output circuit for providing a control signal to the fabric processor; and (c) an open loop PLC controller connected to the input circuit and the output circuit for selectively providing a first fixed control signal or a second fixed control signal for controlling the fabric processor in response to a change in the desired fabric parameter of the moving fabric web from a pre-set value.

Still another aspect of the present invention is to provide a fabric width control system for a fabric compactor for compacting a moving fabric web. The system includes: (a) a vision assembly for measuring the width of the moving fabric web downstream of the fabric compactor; (b) a mechanical spreader located upstream of the fabric compactor; (c) a controller connected to the vision assembly and the mechanical spreader for controlling the position of the mechanical spreader in response to a change in the width of the moving fabric web from a pre-set value, the controller including: (i) an input circuit for receiving an input signal representative of a desired fabric width of the moving fabric web downstream of the fabric compactor; (ii) an output circuit for providing a control signal to the fabric compactor; and (iii) an open loop PLC controller connected to the input circuit and the output circuit for selectively providing a first fixed control signal or a second fixed control signal for controlling the fabric compactor in response to a change in the desired fabric width of the moving fabric web from a pre-set value; and (d) a cloth stabilizer located downstream of the fabric compactor for maintaining the moving fabric web at a predetermined position with respect to the vision assembly.

These and other aspects of the present invention will become apparent to those skilled in the art after a reading of the following description of the preferred embodiment when considered with the drawings.

DESCRIPTION OF THE PREFERRED EMBODIMENTS

Figure 1:
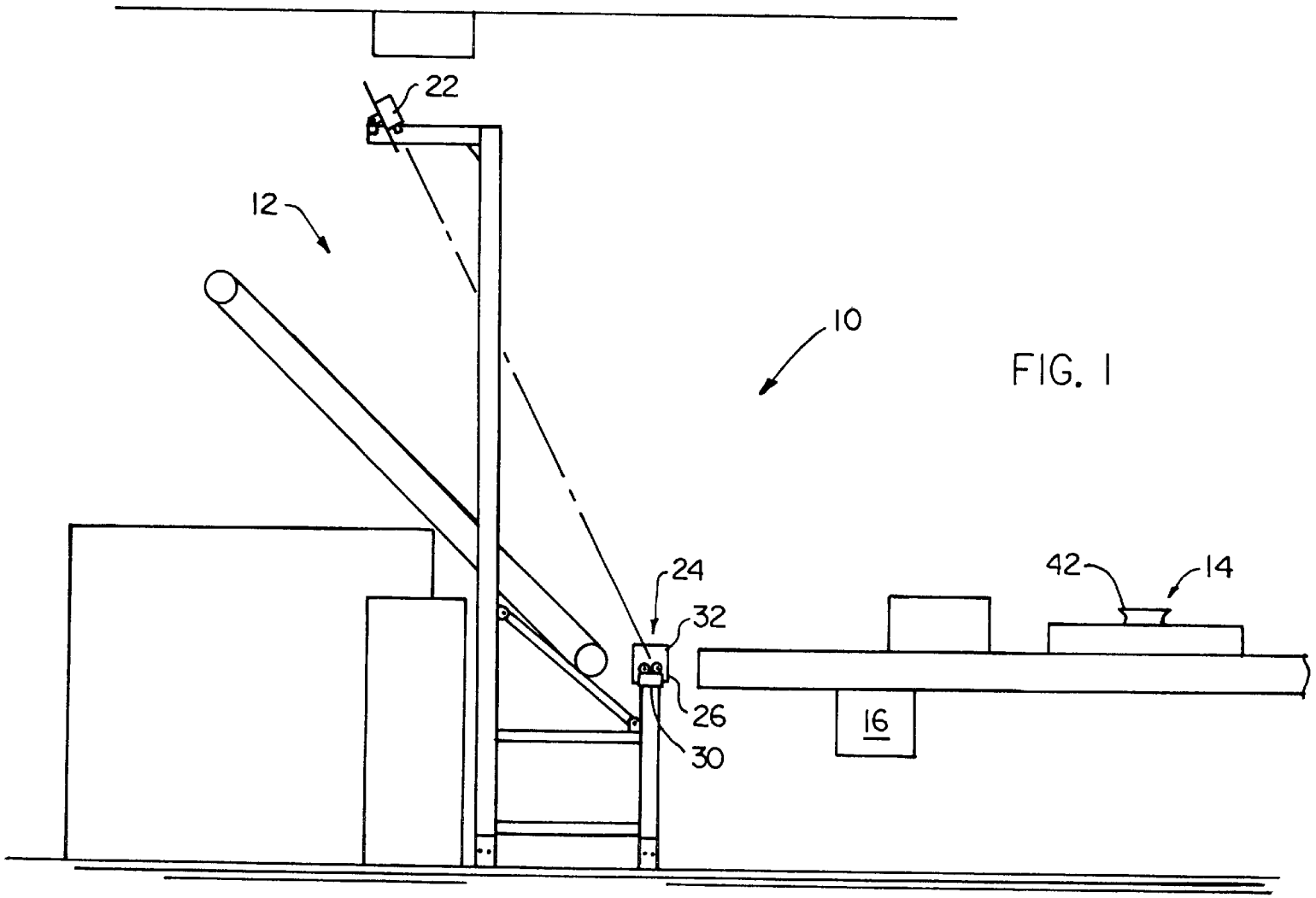
FIG. 1 is a side elevational view of a fabric width control system constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a fabric width control system, generally designated 10 is shown constructed according to the present invention. The fabric width control system 10 includes three major sub-assemblies: a vision system 12; a mechanical spreader 14; and a control system 16 for controlling the position of mechanical spreaders 14 in response to a control signal from vision system 12. In addition, in the preferred embodiment, the present invention also includes a cloth stabilizer assembly having a pair of spaced, transverse rollers located at a fixed distance from the camera to help maintain the position of surface of the fabric with respect to the camera, thereby increasing the accuracy of the measurements of the fabric web.

Vision system 12 includes an overhead camera 22 aimed at a contrast panel 24 located on the opposite side of the moving fabric web. In the preferred embodiment, camera 22 is a line scan type digital camera. In the most preferred embodiment, camera 22 provides an analog voltage output proportional to the width of the fabric. The utilization of a "smart" camera which provides analog voltage output, results in substantial simplification of the control circuit since the controller does not have to convert the line scan measurements into analog voltage, but can take the voltage directly from the camera. One such camera is a model HVS 256-135 available from TFE of France. Such a camera has a resolution of about 0.029 inches at a distance of about 100 inches, depending in part on the lens chosen.

In order to make accurate measurements of the width of the moving fabric web, it is necessary that there by a contrast between the moving fabric web and a reference. For a single color fabric, any contrasting surface behind the moving fabric web would be sufficient. However, finished fabric webs may be of any color from bleached white to bright red to black. Accordingly, in the preferred embodiment of the present invention, contrast panel 24 is a back light panel.

In the preferred embodiment, the back light panel includes at least one fluorescent tube 26 for providing a reference light source. In addition, it has been found because of the speed of the moving fabric web and the sampling rate of the camera, the conventional fluorescent ballast will produce a flicker which may result in errors in measurement. Accordingly, in the preferred embodiment of the present invention the ballast 30 is replaced with a high frequency ballast of about 20 kilohertz. One suitable high frequency ballast is a Valmont P/NE240SR120. In addition, in the preferred embodiment, a diffuser panel 32 is mounted above the fluorescent tubes 26 to further improve uniformity of the light source.

Figure 2:
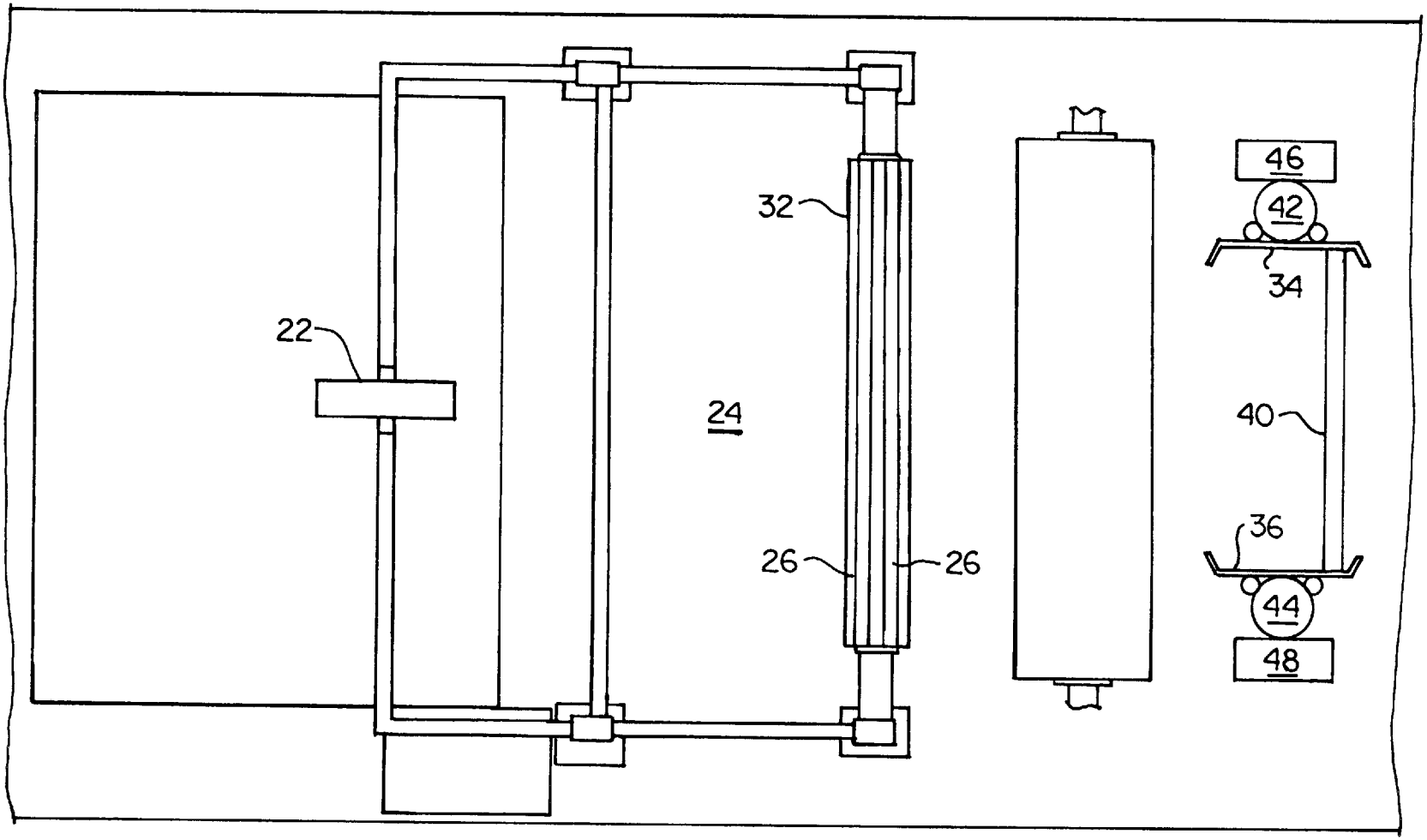
FIG. 2 is top view of the fabric width control system shown in FIG. 1.

The mechanical spreader assembly 14 is generally conventionally designed and may vary from one compactor to another. In the embodiment shown in FIG. 1 and 2, the mechanical spreader assembly 14 includes a pair of spaced apart spreader bars 34, 36 which are forced outwardly by at least one compressed gas tube 40 attached between the spreader bars. Contained rollers 42, 44 lies against the pressure of the gas tube 40 and hold the spreader bars 34, 36 in position between one or more pairs of guide wheels. Drive means 46, 48 move contained rollers 42, 44 inwardly or outwardly in response to measurements made by vision system 12.

In the preferred embodiment, control system 16 is an open loop PLC control. An open loop controller does not provide direct feedback from the mechanical spreader as to its position. Rather such an open loop controller system recognizes that the output from the fabric compactor varies not only as a function of the position of the mechanical spreaders but also as to the type and quality of the fabric itself. As discussed earlier, conventional prior art PID loop controllers, because they make an instantaneous measurement of the width of the fabric and try to control the position of the spreaders which is acting upstream on a web moving about 80 yards a minute have a tendency to go into an oscillation mode because the condition of the fabric that caused a variation in width, may have already changed by the time the measurement of the width from the compactor occurs. The control system of the present invention utilizes two techniques to minimize this tendency to oscillate.

First, the control system 16 of the present invention utilizes a programmable logic controller (PLC). A PLC allows the output from camera 22 to be sampled, averaged and curved smooth as opposed to the instantaneous measurement made by a PID type controller. Accordingly, in the preferred embodiment, ten measurements are made every four yards. This is a sample rate of about one measurement every 0.3 seconds. The PLC discards the highest and lowest measurement and averages the remaining eight measurements. By averaging the width measurements over a portion of the fabric web, localized variations are discounted and a truer measure of the fabric width exiting the compactor is obtained. In the preferred embodiment of the present invention, a speed coder is added to the compactor to measure the speed of the cloth in order that the number of measurements per yard remains constant.

A second technique utilized at the same time as averaging is that the PLC of the present invention is programmed to selectively provide either a long or a short control pulse to the mechanical separator depending on the error band measured. For example, on a 600 mm fabric web, if an error of greater than 30 mm is detected, a three second control pulse would be sent to the drive means 46, 48 to control the width of the mechanical spreader. However, if the error is less than about 10 mm, the PLC sends out a control signal of only about 0.3 seconds. By selectively providing either a long or short control pulse depending on the amount of error, the control system prevents large oscillations from occurring. Specifically, while an oscillation may occur outside a 10 mm error range, the control signal is limited to 0.3 seconds thereby limiting the amount of oscillation that can occur. Thus, while the tendency of an open loop control system to oscillate is not eliminated, it is generally controlled by the selected use of a long or short control pulse to within acceptable limits for a predetermined error band.

Figure 4:
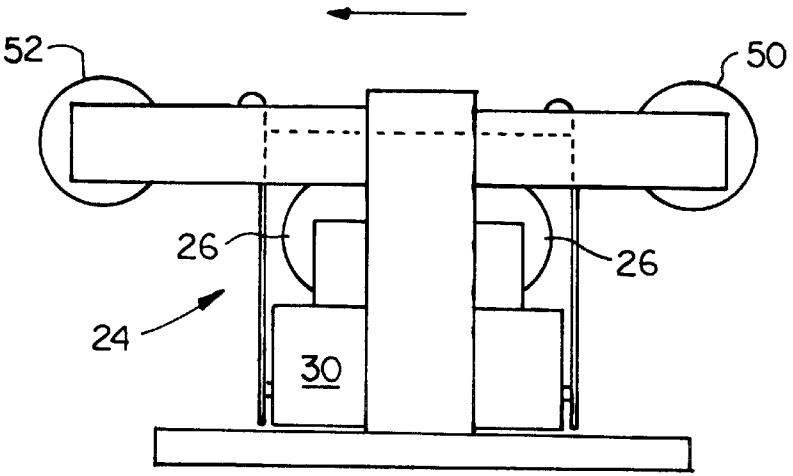
FIG. 4 is an enlarged side view of the cloth stabilizer and back light panel assemblies.
Figure 3:
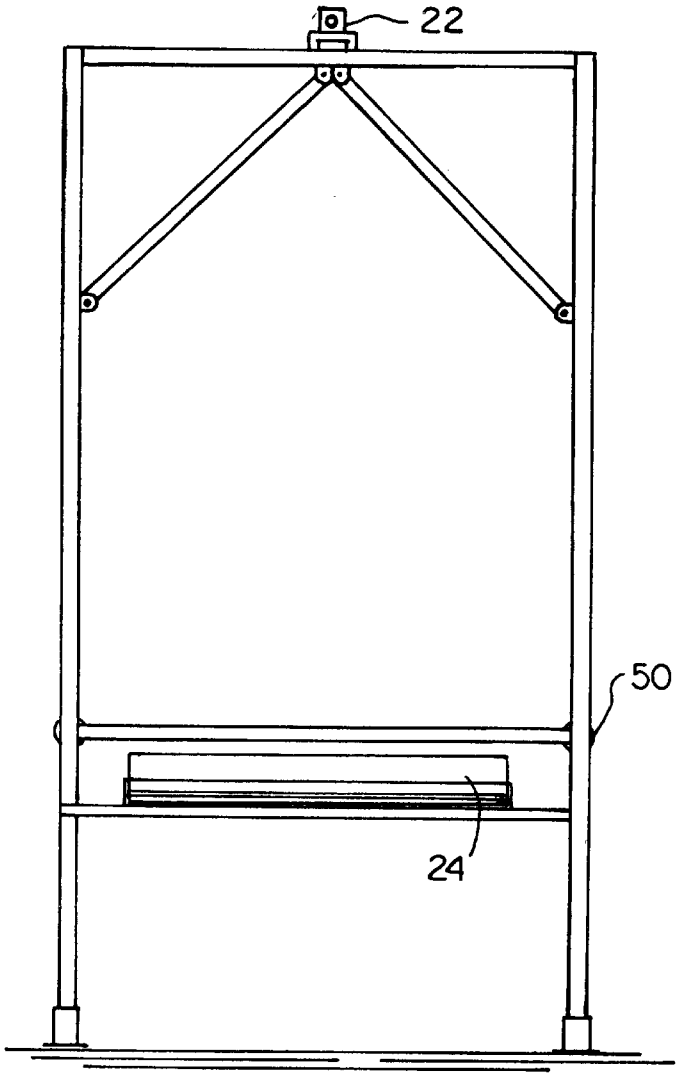
FIG. 3 is an in view of the fabric width control system shown in FIG. 1.

As best seen in FIGS. 3 and 4, in the preferred embodiment, the cloth stabilizer assembly includes a pair of spaced, transverse rollers 50,52 attached to a frame located adjacent to the contrast panel 24 to minimize the flutter of the cloth as it travels across the viewing area of the camera. The rollers located adjacent to the contrast panel 24 are located at a fixed distance from the camera therefore providing a stable surface as a reference point for the camera with respect to the moving fabric web. These rollers do not float with the cloth but remain fixed with respect to the camera. This results in improvement in the accuracy of the measurement of the width of the cloth since the distance between the camera and the cloth remains generally constant.

Figure 5:
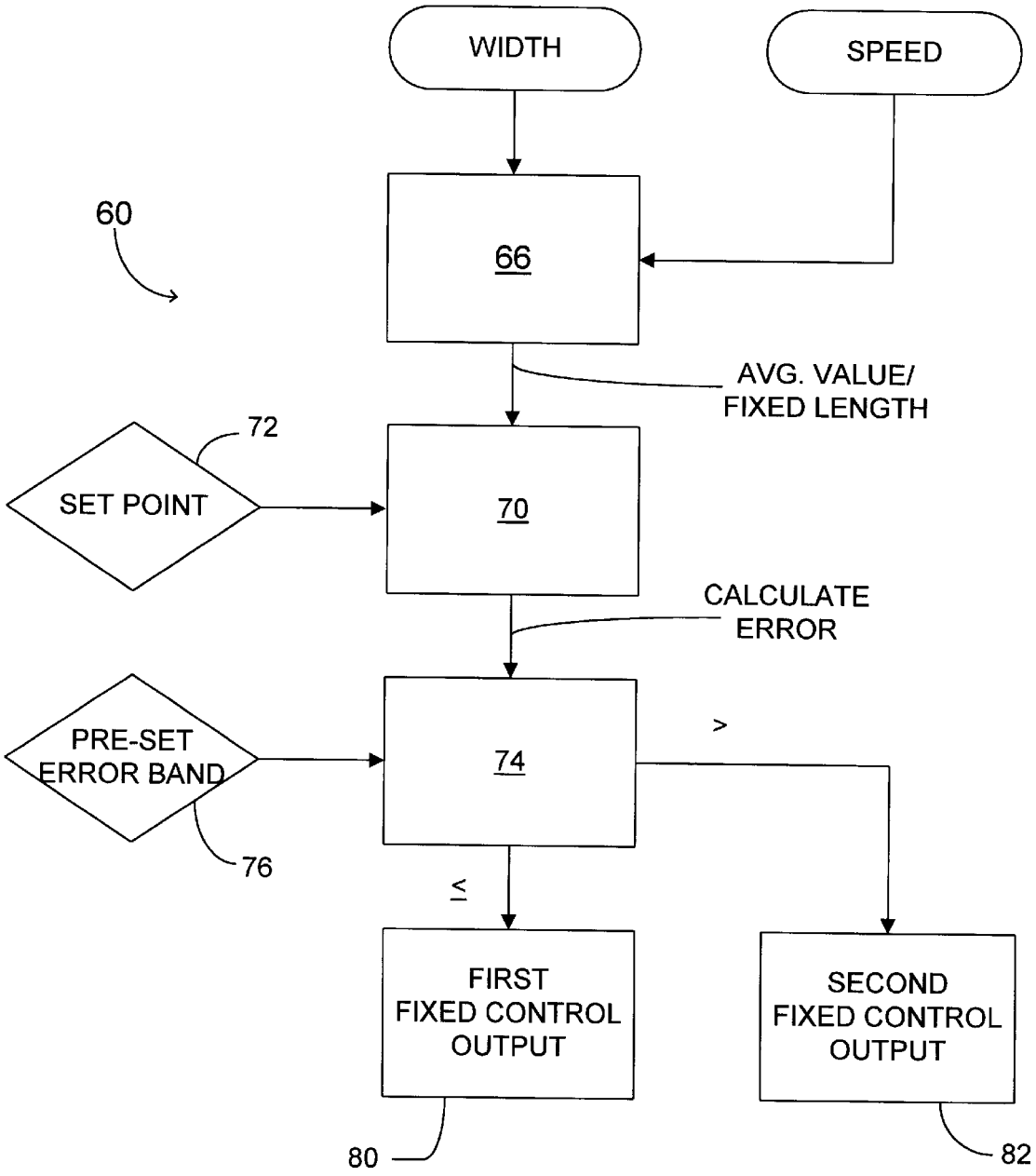
FIG. 5 is block diagram of the controller of the present invention.

In operation and as best seen in FIG. 5, a preferred embodiment of the control system, generally designated 60, is shown. The measured width 62 and measured speed 64 of the compactor are received by an averaging module 66 which calculates an average width value for a fixed length of cloth, thereby eliminating sampling variations due to changes in the speed of the compactor. This calculated average width value is compared by comparator module 70 against a pre-set width set point 72 to produce a calculated error value. The calculated error value is compared by a second comparator module 74 against pre-set error band set point 76. If the error value falls within a first, smaller error band, a first, fixed control output signal is sent to the compactor to make a relatively small correction in the width of the fabric. If the error value falls within a second, larger error band, a second, fixed control output signal is sent to the compactor to make a relatively large correction in the width of the fabric. As discussed above, while open loop control systems, such as this, inherently are prone to oscillate, the first error band is chosen by experimentation to produce an acceptable degree of oscillation. If, the error value exceeds the first error band, the control system provides a relatively large correction control signal sufficient to adjust the width back into the first error band. This results in a simple and rugged control system which is readily adapted to a variety of compactors or the like without the need for special tuning and constant maintenance.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric width control system for a fabric compactor for compacting a moving fabric web, said system comprising:

(a) a vision assembly for measuring the width of the moving fabric web downstream of said fabric compactor;

(b) a mechanical spreader located upstream of said fabric compactor; and (c) a controller connected to said vision assembly and said mechanical spreader for controlling the position of said mechanical spreader in response to a change in the width of the moving fabric web from a pre-set value.

2. The apparatus according to claim 1, further including a cloth stabilizer located downstream of said fabric compactor for maintaining said moving fabric web at a pre-determined position with respect to said vision assembly.

3. The apparatus according to claim 1, wherein said vision assembly includes a video camera positioned by one surface of said moving fabric web and a contrast panel positioned by the opposite surface of said moving fabric web.

4. The apparatus according to claim 3, wherein said video camera is a line scan video camera.

5. The apparatus according to claim 3, wherein said video camera provides an analog output proportional to the width of said moving fabric web.

6. The apparatus according to claim 3, wherein said contrast panel is a back light panel.

7. The apparatus according to claim 6, wherein said back light panel includes at least one florescent tube and a high frequency ballast connected to said florescent tube.

8. The apparatus according to claim 7, wherein said high frequency ballast connected to said florescent tube is operable at about 20 KHz.

9. The apparatus according to claim 6, wherein said back light panel includes a translucent diffuser panel between said light panel and said moving fabric web.

10. The apparatus according to claim 1, wherein said mechanical spreader includes a pair of opposed spreader bars, means for biasing said spreader bars outwardly, and at least one pair of contain rollers for controlling the outward position of said spreader bars.

11. The apparatus according to claim 10, wherein said contain rollers include drive means responsive to said control system.

12. A control system for a textile apparatus for processing a moving fabric web, said system comprising:

(a) an input circuit for receiving an input signal representative of a desired fabric parameter of the moving fabric web downstream of said fabric processor;

(b) an output circuit for providing a control signal to said fabric processor; and (c) an open loop PLC controller connected to said input circuit and said output circuit for selectively providing a first fixed control signal or a second fixed control signal for controlling said fabric processor in response to a change in the desired fabric parameter of the moving fabric web from a pre-set value.

13. The apparatus according to claim 12, wherein said first fixed control signal is selectively provided in response to a change within a first predetermined error band and said second fixed control signal is selectively provided in response to a change within a second, substantially greater predetermined error band.

14. The apparatus according to claim 13, wherein said first fixed control signal provides a substantially smaller change in the desired fabric parameter of the moving fabric web than said second fixed control signal, said change being within predetermined oscillation limits of said fabric processor.

15. The apparatus according to claim 14, wherein said second fixed control signal provides a substantially larger change in the desired fabric parameter of the moving fabric web than said first fixed control signal, said change being outside predetermined oscillation limits of said fabric processor.

16. The apparatus according to claim 12, wherein said PLC controller averages said input signal representative of a desired fabric parameter of the moving fabric web downstream of said fabric processor.

17. The apparatus according to claim 16, wherein said control system includes a speed sensor for measuring the speed of said moving fabric web and said PLC controller averages said input signal representative of a desired fabric parameter of the moving fabric web downstream of said fabric processor a fixed number of times for a predetermined length of said moving fabric web.

18. A fabric width control system for a fabric compactor for compacting a moving fabric web, said system comprising:

(a) a vision assembly for measuring the width of the moving fabric web downstream of said fabric compactor;

(b) a mechanical spreader located upstream of said fabric compactor;

(c) a controller connected to said vision assembly and said mechanical spreader for controlling the position of said mechanical spreader in response to a change in the width of the moving fabric web from a pre-set value, said controller including: (i) an input circuit for receiving an input signal representative of a desired fabric width of the moving fabric web downstream of said fabric compactor; (ii) an output circuit for providing a control signal to said fabric compactor; and (iii) an open loop PLC controller connected to said input circuit and said output circuit for selectively providing a first fixed control signal or a second fixed control signal for controlling said fabric compactor in response to a change in the desired fabric width of the moving fabric web from a pre-set value; and (d) a cloth stabilizer located downstream of said fabric compactor for maintaining said moving fabric web at a pre-determined position with respect to said vision assembly.

19. The apparatus according to claim 18, wherein said vision assembly includes a video camera positioned by one surface of said moving fabric web and a contrast panel positioned by the opposite surface of said moving fabric web.

20. The apparatus according to claim 19, wherein said video camera is a line scan video camera.

21. The apparatus according to claim 19, wherein said video camera provides an analog output proportional to the width of said moving fabric web.

22. The apparatus according to claim 19, wherein said contrast panel is a back light panel.

23. The apparatus according to claim 22, wherein said back light panel includes at least one florescent tube and a high frequency ballast connected to said florescent tube.

24. The apparatus according to claim 23, wherein said high frequency ballast connected to said florescent tube is operable at about 20 KHz.

25. The apparatus according to claim 22, wherein said back light panel includes a translucent diffuser panel between said light panel and said moving fabric web.

26. The apparatus according to claim 18, wherein said mechanical spreader includes a pair of opposed spreader bars, means for biasing said spreader bars outwardly, and at least one pair of contain rollers for controlling the outward position of said spreader bars.

27. The apparatus according to claim 26, wherein said contain rollers include drive means responsive to said control system.

28. The apparatus according to claim 18, wherein said first fixed control signal is selectively provided in response to a change within a first predetermined error band and said second fixed control signal is selectively provided in response to a change within a second, substantially greater predetermined error band.

29. The apparatus according to claim 28, wherein said first fixed control signal provides a substantially smaller change in the desired fabric parameter of the moving fabric web than said second fixed control signal, said change being within predetermined oscillation limits of said fabric processor.

30. The apparatus according to claim 29, wherein said second fixed control signal provides a substantially larger change in the desired fabric parameter of the moving fabric web than said first fixed control signal, said change being outside predetermined oscillation limits of said fabric processor.

31. The apparatus according to claim 18, wherein said PLC controller averages said input signal representative of a desired fabric parameter of the moving fabric web downstream of said fabric processor.

32. The apparatus according to claim 31, wherein said control system includes a speed sensor for measuring the speed of said moving fabric web and said PLC controller averages said input signal representative of a desired fabric parameter of the moving fabric web downstream of said fabric processor a fixed number of times for a predetermined length of said moving fabric web.

33. A method for controlling the width of a moving fabric web from a fabric compactor, said method comprising the steps of:

(a) measuring the width of the moving fabric web downstream of said fabric compactor using a vision assembly; and (b) controlling the position of a mechanical spreader located upstream of said fabric compactor in response to a change in the width of the moving fabric web from a pre-set value.

34. A method for controlling the width of a moving fabric web from a fabric processor, said method comprising the steps of:

(a) receiving an input signal representative of a desired fabric parameter of the moving fabric web downstream of said fabric processor;

(b) providing a control signal to said fabric processor; and (c) selectively providing a first fixed control signal or a second fixed control signal for controlling said fabric processor in response to a change in the desired fabric parameter of the moving fabric web from a pre-set value.

35. A method for controlling the width of a moving fabric web from a fabric compactor, said method comprising the steps of:

(a) measuring the width of the moving fabric web downstream of said fabric compactor using a vision assembly;

(b) maintaining said moving fabric web at a predetermined position with respect to said vision assembly;

(c) controlling the position of a mechanical spreader located upstream of said fabric compactor in response to a change in the width of the moving fabric web from a pre-set value using a controller connected to said vision assembly and said mechanical spreader, said controller including: (i) an input circuit for receiving an input signal representative of a desired fabric width of the moving fabric web downstream of said fabric compactor; (ii) an output circuit for providing a control signal to said fabric compactor; and (iii) an open loop PLC controller connected to said input circuit and said output circuit for selectively providing a first fixed control signal or a second fixed control signal for controlling said fabric compactor in response to a change in the desired fabric width of the moving fabric web from a pre-set value.

* * * * *